United States Patent [19]

Ueda et al.

[11] 4,137,136

[45] Jan. 30, 1979

[54] METHOD FOR ELECTROLYZING ALKALI METAL HALIDE AQUEOUS SOLUTION

[75] Inventors: Tadao Ueda; Teruo Nagaya; Kóji Kawada, all of Tokyo, Japan

[73] Assignee: Asahi Denka Kogyo Kabushiki Kaisha, Japan

[21] Appl. No.: 841,436

[22] Filed: Oct. 12, 1977

[30] Foreign Application Priority Data

Oct. 22, 1976 [JP] Japan ..... 51-126275

[51] Int. Cl.[2] ..... C25B 1/26; C25B 1/34

[52] U.S. Cl. ..... 204/98; 204/128

[58] Field of Search ..... 204/98, 128

[56] References Cited

U.S. PATENT DOCUMENTS

| | | | |
|---|---|---|---|
| 3,222,267 | 12/1965 | Tirrell et al. | 204/98 |
| 3,654,104 | 4/1972 | Yoshida et al. | 204/98 |
| 3,901,774 | 8/1975 | Motani et al. | 204/98 |
| 4,057,474 | 11/1977 | Kurtz et al. | 204/257 |

*Primary Examiner*—R. L. Andrews

*Attorney, Agent, or Firm*—Lowe, King, Price & Becker

[57] ABSTRACT

This invention relates to a method for electrolyzing an alkali metal halide aqueous solution in a three-chamber horizontal type electrolytic cell which comprises a top cathode chamber bounded by a cation exchange membrane, a middle chamber, and a bottom anode chamber bounded by a diaphragm. Halogen gas and dilute alkali metal halide solution are taken out of the anode chamber in such a manner as to make the anode chamber work as a gas chamber.

2 Claims, 8 Drawing Figures

METHOD FOR ELECTROLYZING ALKALI METAL HALIDE AQUEOUS SOLUTION

DETAILED EXPLANATION OF THE INVENTION

This invention relates to a horizontal type electrolytic cell having a cation exchange membrane used for electrolyzing an alkali metal halide aqueous solution and a process for electrolysis using the cell.

More particularly, this invention relates to a three-chamber system horizontal type electrolytic cell having a three-chamber structure of cathode chamber/middle chamber/anode chamber used for electrolyzing an alkali metal halide aqueous solution, wherein a cation-exchange membrane and a diaphragm (liquid-permeable membrane) opposite the cation-exchange membrane are provided between a cathode and an anode, and the diaphragm works for preventing the cation-exchange membrane from being attacked and deteriorated by the halogen gas generated at the anode, a free halogen element dissolved in an alkali metal halide aqueous solution and a hypohalogeno-acid ion.

An object of this invention is to provide an electrolytic cell wherein a cation-exchange membrane is effectively protected from attack by a halogen and electrolysis is efficiently carried out at a low voltage. The electrolytic cell of this invention is a three-chamber system horizontal type electrolytic cell which comprises (a) a cathode chamber having a cathode positioned above a cation-exchange membrane substantially horizontally positioned, (b) a middle chamber partitioned with said cation-exchange membrane and a diaphragm (liquid-permeable membrane) positioned at the lower part opposite the cation-exchange membrane and (c) an anode chamber having an anode positioned below said diaphragm (or united with said diaphragm). One of the essential features of this invention is that the anode chamber is always positioned below the cathode chamber and the middle chamber. In this invention, water or a diluted alkali metal hydroxide aqueous solution may be supplied into the cathode chamber, or not. In the latter case, only the water permeated through the cation-exchange membrane into the cathode chamber is used.

This invention further relates to a stacked horizontal type electrolytic cell wherein two or more of the above defined electrolytic cells (unit cells) are arranged vertically with respect to the cation-exchange membrane. An object of the stacked electrolytic cell of this invention is to improve productivity per unit floor area. Water, alkali metal hydroxide and alkali metal halide aqueous solution may be independently charged into each unit cell or they may be charged into the highest unit cell. In the latter process, the alkali metal hydroxide and alkali metal halide aqueous solution discharged from the highest unit cell are successively passed through lower unit cells by means of gravity to finally be taken out as concentrated alkali metal hydroxide aqueous solution from the lowest unit cell and diluted alkali metal halide aqueous solution from each unit cell. A combination system of the former and the latter processes may also be used. In any case, according to this invention, water, alkali metal hydroxide and alkali metal halide aqueous solution can be easily supplied by means of gravity from a tank positioned above the level of the highest unit cell, thus saving energy in comparison with the charge and discharge system or the circulation system of the various conventional vertical type multi-chamber system (filter-press system) electrolytic cells.

It is important in any of the three-chamber system horizontal type electrolytic unit cells or three-chamber system horizontal type stacked electrolytic cells of this invention that the anode chamber be maintained as a gas chamber for halogen gas generated at the anode and the anode chamber not be filled with the diluted alkali metal halide aqueous solution. That is, when electrolysis is carried out while charging alkali metal halide aqueous solution into the horizontal middle chamber partitioned with a cation-exchange membrane positioned horizontally and a diaphragm positioned at the lower part opposite the cation-exchange membrane, alkali metal ion moves upwardly through the cation-exchange membrane into the cathode chamber where the electrolysis of water is carried out at the cathode positioned above the cation-exchange membrane to produce alkali metal hydroxide and hydrogen, and on the other hand halogen ion moves downwardly together with the alkali metal halide aqueous solution through the diaphragm into the anode chamber where the halogen ion is discharged at the anode positioned below or united with the diaphragm to produce halogen gas. Thus, in the anode chamber, the halogen gas generated and the undecomposed alkali metal halide aqueous solution are stored, but the undecomposed alkali metal halide aqueous solution is immediately taken out from the bottom or lower side of the cell without filling the anode chamber and the halogen gas is also taken out from the lower side of the anode chamber.

According to this invention, halogen gas generated at the anode does not move into the middle chamber as a bubble through the diaphragm. This is because the middle chamber is positioned above the anode with the diaphragm intervening between the middle chamber and the anode, and the diaphragm is always covered with the alkali metal halide aqueous solution which flows downwardly through the porous part of the diaphragm. This is an important effect which can be achieved only by the horizontal type electrolytic cell of this invention.

However, if the anode chamber is filled with undecomposed alkali metal halide aqueous solution from the bottom to the diaphragm the halogen gas generated stays between the anode and the diaphragm and electric resistance is increased by this gas bubble, thus remarkably increasing the electrolysis voltage. In addition, a halogen element dissolved in the alkali metal halide aqueous solution permeates into the middle chamber, and accordingly the concentrations of free halogen and hypohalogeno-acid ion in the alkali metal halide aqueous solution in the middle chamber are increased. The presence of the free halogen and hypohalogeno-acid ion deteriorates the cation-exchange membrane, and therefore the alkali metal halide aqueous solution must be immediately taken out of the anode chamber in such a manner as to prevent the anode chamber from being filled with the solution in order to make the anode chamber work as a gas chamber.

A three-chamber system structure having a neutral diaphragm positioned at the anode side between the anode and cathode opposite a cation-exchange membrane in order to prevent the deterioration of the cation-exchange membrane by halogen gas or dissolved halogen is well known. However, all the conventionally known methods employ a vertical system wherein the cathode, anode, cation-exchange membrane and neutral diaphragm are all disposed vertically. Even if the conventional vertical system were converted to a horizontal system, it was common to dispose the anode at the highest part and the cathode at the lowest part. In any of these conventional systems, the anode chamber partitioned with the diaphragm and anode, and the middle chamber partitioned with the diaphragm and cation-exchange membrane are both always filled with alkali metal halide aqueous solution, and in the anode chamber generated halogen gas and the alkali metal halide aqueous solution are present. In such a case, as mentioned above, a hypohalogeno-acid ion and free halogen element dissolved in the alkali metal halide aqueous solution permeate through the diaphragm into the middle chamber, thus remarkably deteriorating the physical and chemical properties of the cation-exchange membrane. According to the conventional method, in order to prevent this deterioration, the conditions of diaphragm and the operation conditions of the middle chamber have been variously restricted, but a satisfactory result could not be obtained and furthermore it was not practical since the structure of the electrolytic cell and its operation conditions had to be made complicated.

The present invention is more concretely illustrated by referring to the following drawings. In each drawing, component parts having the same function are expressed by the same number.

Figure 1:
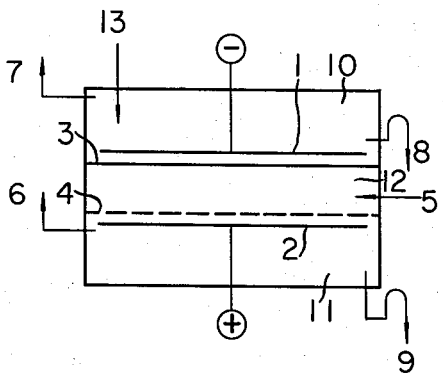
FIG. 1 shows a fundamental structure of an electrolytic unit cell used in carrying out the present invention.

The numerals in the drawings respectively represent as follows: 1—cathode; 2—anode; 3—cation-exchange membrane; 4—diaphragm (liquid-permeable membrane); 5—conduit (for supplying alkali metal halide aqueous solution); 6—exit (for halogen gas); 7—exit (for hydrogen gas); 8—conduit (for taking out alkali metal hydroxide aqueous solution); 9—conduit (for taking out alkali metal halide); 10—cathode chamber; 11—anode chamber; 12—middle chamber; 13—water or alkali metal aqueous solution; 14—conjunction part of cathode-anode; 13'—water.

FIG. 1 shows a fundamental structure of an electrolytic unit cell of this invention (hereinafter referred to as "unit cell"). The unit cell of this invention is a three-chamber system horizontal type electrolytic cell which comprises a cathode chamber 10 at the upper part, a middle chamber 12 at the middle part and anode chamber 11 at the lower part. The cathode chamber 10 has a cathode 1 positioned above a cation exchange membrane 3 which is horizontally positioned and constitutes the bottom of the cathode chamber 10. The middle chamber 12 is partitioned with the cation exchange membrane 3 and a diaphragm 4 horizontally positioned opposite the cation-exchange membrane 3. The anode chamber 11 has an anode 2 positioned united with or close to the liquid-permeable membrane 4. Alkali metal halide aqueous solution material is supplied into the middle chamber 12 through a conduit 5. When voltage is applied to both cathode and anode, alkali metal cations pass through the cation exchange membrane 3 and form hydrogen and alkali metal hydroxide at cathode 1 in the cathode chamber 10 positioned above. The hydrogen and alkali metal hydroxide aqueous solution thus formed are taken out of the electrolytic cell respectively through an exit 7 and a conduit 8 as products. The alkali metal halide aqueous solution supplied into the middle chamber 12 is on the other hand filtered through the diaphragm 4 and flows downwardly into the anode chamber 11. The halide is then discharged and produces halogen gas at the anode 2 positioned united with or close to the lower part of the diaphragm. The electrolyzed and diluted alkali metal halide aqueous solution is rapidly taken out of the cell through a conduit 9 without being allowed to remain there, while the anode chamber 11 works substantially as a halogen gas chamber and the halogen gas is taken out of the cell through an exit 6.

The cation exchange membrane 3 used in the present invention is not especially limited and any type of membrane can be used provided that it is active, selectively permeable for cations, and substantially impermeable for the alkali metal halides and hydroxide ions formed at the cathode under such conditions that an alkali metal halide aqueous solution, for example 30% sodium chloride aqueous solution, can be electrolyzed and form a concentrated sodium hydroxide solution at the cathode and chlorine at the anode. This type of cation exchange membrane is fully described in Japanese Patent Publication No. 40-26333.

Among the physical properties of the diaphragm used in the electrolytic cell of the present invention, liquid permeability is very important in order to obtain an appropriate electrolysis rate of alkali metal halide aqueous solution at a predetermined electric current density. In the electrolytic cell of the present invention, the electrolysis rate of alkali metal halide aqueous solution is controlled only by the amount of the alkali metal halide aqueous solution passed through the diaphragm. The electric cell of the present invention is operated at an electric current density of 10 $A/dm^2$ or higher in such a manner as to maintain the electrolysis rate of the alkali metal halide aqueous solution at 80% at maximum, and accordingly the amount of the alkali metal halide aqueous solution to be passed through the diaphragm should preferably be at least 1.5 $ml/min\text{-}dim^2$.

The material of the diaphragm is not especially limited and any type of material can be used, provided that it is resistant to chlorine and alkali metal halide, and has excellent mechanical strength and size stability. Recently, the use of fluorine type synthetic resin membranes such as ethylene tetrafluoride and the like has been proposed. This type of membrane is excellent with respect to durability but is poor with respect to wetting property for water. However, it is known that this type of membrane can be modified into a paper-like membrane having an excellent hydrophilic property by spinning with a hydrophilic fibrous material such as asbestos as disclosed in Japanese Patent Application Laid Open No. 50-37682. The membrane thus modified can be satisfactorily used as a diaphragm (liquid-permeable membrane) in the present invention.

A cation exchange membrane which can be used in the present invention may be produced by preparing a paper-like material having a thickness of 0.5 mm from a mixture of an aqueous dispersion of ethylene tetrafluoride-propylene hexafluoride copolymer with inorganic fiber such as asbestos fiber, carbon fiber and the like, impregnating the paper-like material with "XR" resin (Trade Name of Du Pont Co.), air-drying the impregnated paper-like material and heating the air-dried paper-like material at 250° C. for 200 minutes to cure the resin. The membrane thus produced is a porous and liquid-permeable membrane fixed with a fluorine type resin having cation-exchange radicals, and has an ion-exchange capacity of 0.20 meq/g (dry basis). "Nafion 701" (Trade Name of Du Pont Co.) which is a porous and liquid-permeable cation-exchange membrane can also be satisfactorily used in the present invention.

In the drawings, part of the middle chamber 12 is enlarged to clearly show the structure of the electric cell, but the actual distance between the upper wall and the bottom wall of the middle chamber is usually fixed at 2–3 mm in order to lower the electrolysis voltage as much as possible and reduce the electric power consumed. The cathode is press-adhered directly to the cation-exchange membrane or fixed to the cation-exchange membrane with a screen such as polypropylene intervening between the cathode and the cation-exchange membrane, while the anode is united with the diaphragm or fixed to the diaphragm with a screen such as Teflon intervening between the anode and the diaphragm.

The distance between the cathode and the anode is usually 3–5 mm.

Examples of cathode materials which can be used in the present invention include iron, stainless steel, nickel-coated iron and the like. Examples of anode materials which can be used in the present invention include a metallic electrode (DSE), that is, titanium coated with a noble metal of the platinum group or the oxide thereof.

FIGS. 2–5 illustrate a piping system with regard to the cathode solution, the alkali metal halide aqueous solution charged into the middle chamber and the diluted alkali metal halide aqueous solution flowing down to the anode chamber in the three-chamber system horizontal type electrolytic unit cell of this invention as shown in FIG. 1.

Figure 2:
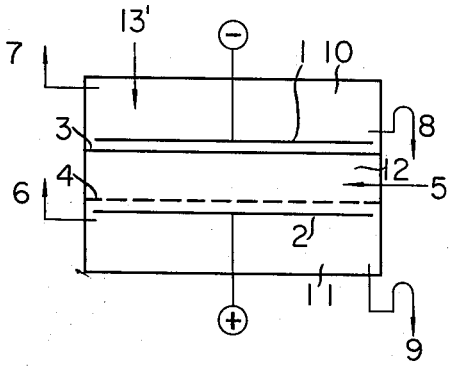
FIGS. 2-5 illustrate a piping system with regard to the cathode solution, the alkali metal halide aqueous solution charged into the middle chamber and the diluted alkali metal halide aqueous solution flowing down to the anode chamber in the three-chamber system horizontal type electrolytic unit cell of this invention.
Figure 3:
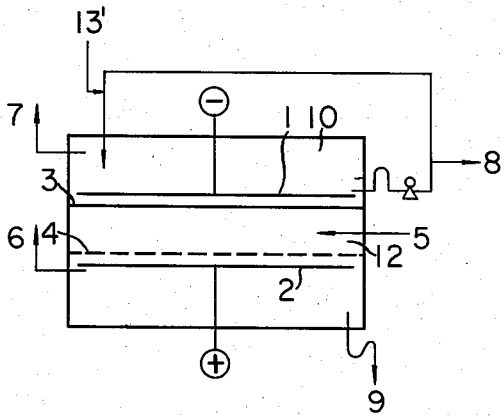
Figure 4:
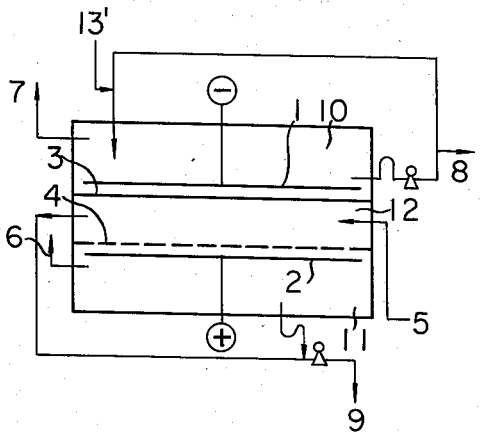
Figure 5:
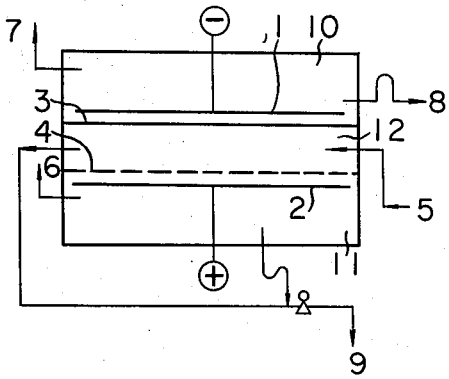

That is, FIG. 2 illustrates a system wherein water 13' is introduced into the cathode chamber from an outer source and alkali metal hydroxide having a predetermined concentration is taken out of the cell in accordance with the amount of $Na^+$ moved into the cathode chamber. FIG. 3 illustrates a system wherein the cathode chamber solution is circulated while introducing water 13', thus making the concentration of the solution in the cathode chamber uniform. FIG. 4 illustrates a practical operation system wherein, in addition to the system of FIG. 3, alkali metal halide aqueous solution is charged into the middle chamber in an amount in excess of the amount of the solution passing through the diaphragm and the excess amount of the solution is taken out of the cell together with the diluted solution flowing down into the anode chamber. FIG. 5 illustrates a system for obtaining highly concentrated alkali metal hydroxide from the cathode chamber, wherein the systems of the middle chamber and cathode chamber are the same as those of FIG. 4 but in the cathode chamber a predetermined amount of water or alkali metal hydroxide is stored without adding water or alkali metal hydroxide from an outer source and the excessive amount increased by the movement of the solution through the membrane overflows out through an overflow pipe.

These systems and methods are all modifications of the three-chamber system horizontal type electrolytic unit cell of this invention.

Figure 6:
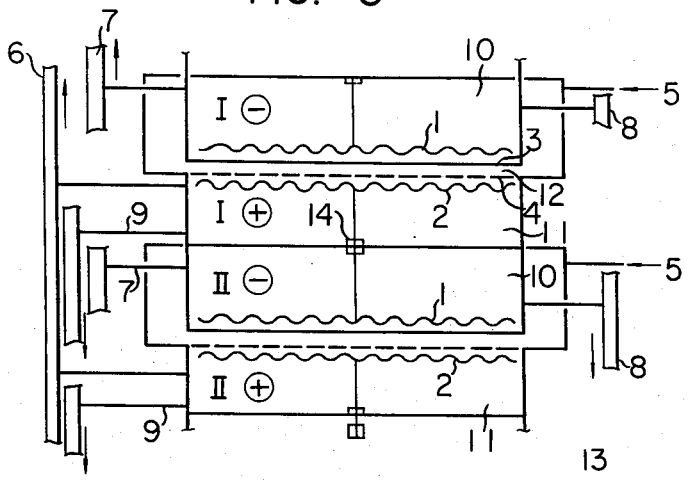
FIG. 6 illustrates a piping system with regard to the starting material and products of a stacked electrolytic cell wherein two unit cells of this invention are vertically arranged.
Figure 7:
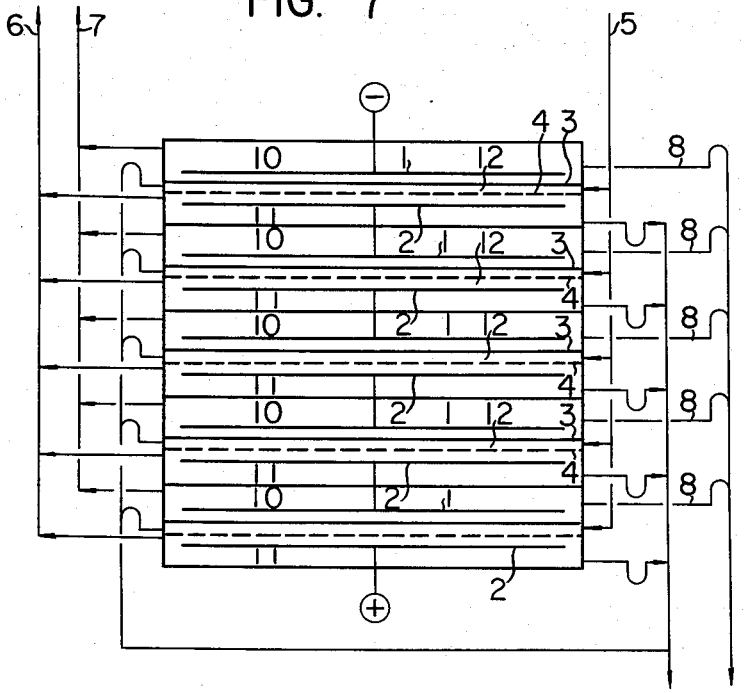
FIG. 7 illustrates a piping system with regard to the starting material and products of a stacked electrolytic cell wherein five unit cells of this invention are vertically arranged.

FIGS. 6 and 7 illustrate examples of a stacked (multi-column) electrolytic cell wherein a plurality of the three-chamber system horizontal type electrolytic unit cells of this invention are vertically arranged for the purpose of producing sodium hydroxide and hydrogen at the cathode and chlorine gas at the anode using a sodium chloride solution as an alkali metal halide aqueous solution. FIG. 6 shows a two-column electrolytic cell in which two unit cells are vertically arranged and FIG. 7 shows a five-column electrolytic cell in which five unit cells are vertically arranged. However, the number of unit cells vertically arranged is not especially limited.

FIG. 6 shows a piping system for liquid and gas introduced into and taken out of the cathode chamber, middle chamber and anode chamber of the two-column electrolytic cell. FIG. 7 is the same figure with regard to the five-column electrolytic cell as shown in FIG. 6.

Figure 8:
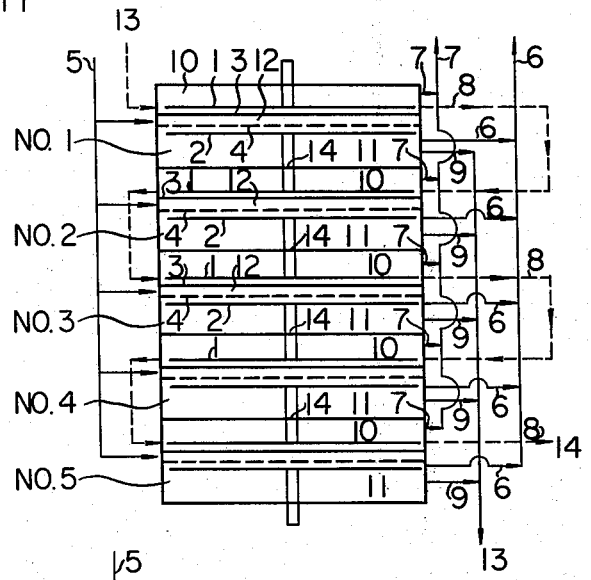
FIG. 8 shows a piping system wherein five unit cells of this invention are vertically arranged and alkali metal hydroxide generated in the cathode chamber of the highest unit cell is successively circulated toward a cathode chamber of a lower unit cell.

FIG. 8 shows a piping system wherein five unit cells are vertically arranged and alkali metal hydroxide is circulated toward the bottom level. Thus, in FIG. 8, alkali metal hydroxide aqueous solution is taken out of the highest unit cell (No. 1) through conduit 8, and is successively introduced into the respective cathode chambers of the second unit cell (No. 2), the third unit cell (No. 3), the fourth unit cell (No. 4) and the fifth unit cell (No. 5) in that order, and is finally taken out of the system through conduit 8 of the fifth unit cell.

The present invention is more fully illustrated by the following examples.

EXAMPLE 1

A cation exchange membrane was prepared by sulfonating styrene-divinyl benzene-ethyl vinyl benzene-polybutadienedioctyl phthalate-diethyl benzene (1:4:4:1:1:1) copolymer. A neutral diaphragm having a saturated salt solution passage rate of 0.8 ml/cm$^2$-hr (under a saturated salt solution pressure of 1 cm) was prepared by heat-treating at 300° C. a paper-like membrane having a thickness of 0.5 mm obtained from ethylene tetrafluoride, asbestos and titanium oxide (5:3:1) and treating the heat-treated membrane with acetone to make it hydrophilic. An electrolytic cell was constructed by (a) attaching the above-prepared neutral diaphragm onto a mesh-like metallic anode horizontally fixed; (b) placing a fluorine resin net having a thickness of 2 mm on the diaphragm as a spacer and placing the above-prepared cation-exchange membrane on the spacer, thus constituting a middle chamber; and (c) placing a polypropylene screen having a thickness of 0.5 mm on the cation-exchange membrane and placing an iron mesh cathode on the polypropylene screen.

A saturated salt solution was charged into the middle chamber at a rate of 7 ml/cm$^2$-hour. The solution was then moved into the anode chamber at a rate of 5 ml/cm$^2$-hour and was rapidly taken out from the electric cell to keep the anode chamber as a gas chamber.

In the cathode chamber, a 20% sodium hydroxide solution was charged at the beginning of the operation. Water was then added to the cathode chamber in such a manner as to maintain the concentration of 20% sodium hydroxide as the electrolysis proceeds and the alkali metal hydroxide formed in the cathode chamber was taken out of the system.

The operation was carried out at 80° C. and at a current density of 20 A/dm$^2$.

The conditions and the efficiency of the operation were as follows:

Cell voltage: 3.5 V

Decomposition rate of the salt solution: 30%

Electric current efficiency: 92–93%

Purity of chlorine gas formed: 98.5%

Concentration of chlorine gas in the salt solution in the middle chamber: 0.5 ppm or less Even after operating for 8 months, the cation-exchange membrane was not deteriorated and the electrolysis efficiency was not lowered.

Comparative Example 1

An operation was carried out in the same manner as in Example 1, except that the anode chamber was charged with a salt solution. The decomposition ratio of the salt solution was 30%, but the cell voltage was 5.0 V and the amount of free chlorine gas ($Cl_2$) in the middle chamber reached 15 ppm. Accordingly, the cation-exchange membrane began to deteriorate after 2 months of operation, and was damaged after 4 months of operation. The electric current efficiency was lowered to 50% and the concentration of sodium hydroxide became less than 20%.

EXAMPLE 2

The same procedure as in Example 1 was repeated, except that a sulfonated copolymer film of styrene-divinyl benzene-ethyl vinyl benzene-polybutadiene-dioctyl phthalate-diethyl benzene (8:40:40:12:10:10) was used as a cation-exchange membrane and 40% sodium hydroxide solution was charged into the cathode chamber and 40–45% sodium hydroxide solution was taken out of the system.

The conditions and the efficiency of the operation were as follows:

Cell voltage in the cell: 3.8 V

Decomposition rate of the salt solution: 30%

Purity of chlorine gas formed: 98.0%

Concentration of chlorine gas in the salt solution in the middle chamber: 0.7 ppm or less Even after operating for 6 months, the cation-exchange membrane was not deteriorated.

When the anode chamber was charged with a salt solution in the same manner as in Comparative Example 1, the cell voltage became 5.4 V and the amount of free chlorine gas ($Cl_2$) in the middle chamber reached 17 ppm. Accordingly, the cation-exchange membrane began to deteriorate after 70 days of operation. The electric current efficiency was lowered to 60% and the concentration of sodium hydroxide solution was also lowered to 30%.

EXAMPLE 3

A unit cell wherein the effective sectional areas of the membrane and electrode are both 1 m$^2$ and an electric current density of 25 A/dm$^2$ is applied was prepared using the same cation-exchange membrane as used in Example 1 and a mixed spun ethylene tetrafluoride-asbestos diaphragm having a thickness of 0.6 mm and a liquid passage rate of 10 ml/cm$^2$-hour ($H_2O$ 2 cm pressure). Five unit cells as mentioned above were vertically arranged to construct a stacked electrolytic cell. A salt solution was charged into the middle chamber of each cell, and the diluted salt solution was taken out in such a manner as to make each anode chamber a gas chamber (see FIG. 8).

Referring to FIG. 8, water was charged into the highest cathode chamber (No. 1) and sodium hydroxide solution taken out of the highest cathode chamber (No. 1) was charged into the second cathode chamber (No. 2). Thus, sodium hydroxide solution was successively passed through the third (No. 3), the fourth (No. 4) and the fifth (No. 5) cathode chambers in that order, and concentrated sodium hydroxide solution was taken out of the lowest cathode chamber (No. 5).

When water was charged into the highest cathode chamber (No. 1) in an amount of 12.8 kg/hour and operation was carried out keeping the cell temperature at 80° C. and fixing the decomposition rate of the salt solution as 10–15%, the concentration of sodium hydroxide solution taken out of each cathode chamber was as follows:

No. 1, 20.0%

No. 2, 30.7%

No. 3, 37.23%

No. 4, 41.52%

No. 5, 44.47%

The amount of sodium hydroxide solution taken out from the system was 35.66 kg/hour, and the total electric current efficiency of Nos. 1 - 5 was 85%. Each cell voltage was as follows:

No. 1, 3.5 V

No. 2, 3.6 V

No. 3, 3.75 V

No. 4, 3.8 V

No. 5, 3.9 V

What we claim is:

1. A method for electrolyzing an alkali metal halide aqueous solution in a three-chamber system horizontal type electrolytic cell which comprises (a) a cathode chamber having a cathode positioned above a cation exchange membrane substantially horizontally positioned, (b) a middle chamber partitioned with said cation-exchange membrane and a diaphragm positioned at the lower part opposite the cation-exchange membrane and (c) an anode chamber having an anode positioned below said diaphragm, characterized in that said method comprises charging an alkali metal halide aqueous solution into the middle chamber, taking hydrogen gas and concentrated alkali metal hydroxide aqueous solution having a desired concentration out of the cathode chamber while optionally supplying water or dilute alkali metal hydroxide aqueous solution to the cathode chamber, and taking halogen gas out of the anode chamber and simultaneously taking diluted alkali metal halide aqueous solution out of the anode chamber in such a manner as to make the anode chamber work substantially as a gas chamber.

2. A method for electrolyzing an alkali metal halide aqueous solution in a stacked electrolytic cell wherein a plurality of the three-chamber system horizontal type electrolytic unit cells as defined in claim 1 are arranged vertically, characterized in that said method comprises charging an alkali metal halide aqueous solution into the middle chambers, taking hydrogen gas out of the cathode chambers while optionally supplying water or dilute alkali metal hydroxide aqueous solution to the highest cathode chamber, successively taking alkali metal hydroxide aqueous solution out of an upper cathode chamber and introducing it into a lower cathode chamber to finally take out concentrated alkali metal hydroxide aqueous solution having a desired concentration, and taking halogen gas out of each anode chamber and simultaneously taking diluted alkali metal halide aqueous solution out of each anode chamber in such a manner as to make the anode chamber work substantially as a gas chamber.

* * * * *